US005306354A

United States Patent [19]

Adachi

[11] Patent Number: 5,306,354

[45] Date of Patent: Apr. 26, 1994

[54] METHOD OF BLACKENING TREATING A STAINLESS STEEL STRIP SURFACE

[75] Inventor: Takakatsu Adachi, Shinnanyo, Japan

[73] Assignees: Nisshin Steel Co., Ltd., Tokyo; Chugai Ro Co., Ltd., Osaka, both of Japan

[21] Appl. No.: 902,892

[22] Filed: Jun. 23, 1992

[30] Foreign Application Priority Data

Jul. 10, 1991 [JP] Japan ..... 3-195116

[51] Int. Cl.[5] ..... C21D 1/08

[52] U.S. Cl. ..... 148/235; 148/606

[58] Field of Search ..... 148/205, 235, 606

[56] References Cited

U.S. PATENT DOCUMENTS 4,950,334 8/1990 Nishioka et al. ..... 148/235

FOREIGN PATENT DOCUMENTS 0120373 10/1984 European Pat. Off. .
565675 11/1932 Fed. Rep. of Germany .
2633944 1/1990 France .
55-128529 10/1980 Japan .
1-119628 5/1989 Japan .
2-101123 4/1990 Japan ..... 148/235

*Primary Examiner*—George Wyszomierski
*Attorney, Agent, or Firm*—Wenderoth, Lind & Ponack

[57] ABSTRACT

A blackening treating furnace includes a soot generation burner for blowing an incomplete combustion flame toward a surface of a cold-rolled stainless steel strip moving continuously through the furnace. A pair of secondary air nozzles installed at positions enclosing the incomplete combustion flame blow secondary air toward the surface of the stainless steel strip in directions perpendicular thereto or in directions slightly inclined toward the middle of the incomplete combustion flame. A flame guide air nozzle is installed between the pair of secondary air nozzles and an exhaust duct for drawing and discharging the combustion reaction flame of the incomplete combustion flame and secondary air along the direction of movement of the stainless steel strip. The flame guide air nozzle injects flame guide air toward the combustion reaction flame in a direction perpendicular to the direction of movement of the stainless steel strip or in a direction inclined thereto. The furnace is installed at the upstream side of a continuous annealing furnace and deposits soot on the surface of the stainless steel strip efficiently, uniformly and stably, so that the cold-rolled stainless steel strip can be annealed continuously.

8 Claims, 3 Drawing Sheets

METHOD OF BLACKENING TREATING A STAINLESS STEEL STRIP SURFACE

BACKGROUND OF THE INVENTION

1. Field of the Invention

The present invention relates to a method of blackening treating a surface or surfaces of a stainless steel strip, e.g. a cold-rolled strip, by depositing soot uniformly and stably on the surface in a treating furnace installed separately from and upstream of a continuous annealing furnace for continuous annealing of the strip.

2. Description of the Related Art

Generally, a cold-rolled stainless steep strip is annealed by being passed along a series continuous annealing line comprising, for example an annealing step and a pickling step, in order to eliminate processing strain or the like caused by rolling. Such annealing has been provided widely by an open-air continuous annealing furnace such as of the horizontal type (catenary type). Such continuous annealing furnace is designed to heat the stainless steel strip mainly by direct ignition burners, and therefore the stainless steel strip is heated chiefly by radiation heat. However, since the surface of the stainless steel strip product is required to have a gloss and uniform finish after annealing, the strip is cold-rolled in a cold rolling step before annealing in order to provide a substantial or advanced surface gloss. As a result of such high surface gloss of the stainless steel strip, the rat of head absorption during annealing is extremely low, and it is difficult to obtain high production efficiency of the annealing process. Accordingly, in order to raise the production efficiency of the annealing process, there have been attempted a method of preheating by combustion waste gas in forced convection or preheating of combustion air, a method of increasing radiation heat by raising the annealing furnace temperature over the heating temperature of the stainless steel strip to increase the temperature difference between the material temperature and the furnace wall temperature, a method of improving heat transfer efficiency by direct contact of a high temperature burner flame with the stainless steel strip, and combinations of such methods. It also has been proposed to raise production efficiency by extending the length of the heating run or zone of the annealing furnace.

These methods, however, involve the following problems. First of all, in the method of heating by increasing the radiation heat by raising the temperature difference between the material temperature and the furnace wall temperature, the speed of movement of the stainless steel strip to be heated continuously varies, or quantity of the heat transferred to the stainless steel strip becomes uneven due to contamination of the surface of the stainless steel strip or the like, or abnormality of the material may be caused by extremely exceeding the desired material temperature, or in a worst case the stainless steel strip may be melted down in the annealing furnace, among other troubles.

In the heating method by direct contact of burner flame with the stainless steel strip, such method is effective if the temperature of the stainless steel strip is low. However, when the temperature of the stainless steel strip exceeds a certain range, the surface of the stainless steel strip may be extremely and locally oxidized, or if the speed of movement of the stainless steel strip varies, the temperature of the stainless steel strip can be increased extremely to produce material abnormality.

In the method of extending the heating zone of the continuous annealing furnace, in a new furnace an increased equipment cost is required for the portion of extension, or in an existing furnace it takes much time and cost for modification. Further, after extension of the heating zone of the annealing furnace, the basic unit of the fuel is increased and heating efficiency is lowered.

Accordingly, as a method of enhancing the rate of heat absorption of the stainless steel strip surface without sacrificing the desired properties and quality such as gloss of the stainless steel strip surface and without causing other difficulties, a method of blackening treatment of the surface of a stainless steel cold-rolled strip with soot at the upstream side of the radiation heating zone of the annealing furnace was proposed in Japanese Unexamined Patent Publication (KOKAI) No. JP-A 1-119628 (1989). In such conventional method of blackening treatment of the stainless steel strip surface, plural soot generation burners are needed to blacken the stainless steel strip surface uniformly with soot. If the soot is deposited on the surface of stainless steel strip by burning the fuel with plural soot generation burners, the soot is not deposited uniformly. Thus, in the subsequent continuous annealing furnace the rate of heat absorption is not always raised, and fuel consumption is increased, as confirmed experimentally by the present inventor.

The reasons are as follows. Since the rate of heat absorption of soot has a specific value, if the soot is deposited over a long period of time, the rate of heat absorption is not raised above a certain value. Since the soot is generated in the following steps from the hydrocarbon gas of the fuel, soot progressed up to the oxidation step no longer contributes to the rate of heat absorption because its adhesion to the stainless steel strip is reduced extremely, and the deposited soot easily is peeled off or is vaporized to be in a non-blackening state due to convection in the forced convection preheating zone or heating zone at the upstream side of the continuous annealing furnace in which the strip is passed after the blackening treatment:

(Pyrolysis) --- (Generation of nucleus) --- (Surface growth, combining) --- (Grouping) --- (Oxidation)

Therefore, unless controlled so as not to progress up to the oxidation step by suppressing the soot generation step within the soot grouping step at the exit side of the blackening treating furnace, depending on the speed of movement of the stainless steel strip, it is impossible to deposit uniformly and stably on the surface of the stainless steel strip soot which adheres smoothly to the stainless steel strip and is not easily peeled off or vaporized and is capable of obtaining sufficient heat absorption.

The soot generation burner is supplied with oxygen, air or oxygen-enriched air containing 0.3 or less of the quantity of oxygen necessary to combust completely hydrocarbon gas of the fuel. This generates soot, but it is necessary to feed combustion air properly in order to progress while controlling the soot generation step. It is necessary to control the furnace temperature to be at a relatively low temperature. If the incomplete combustion flame of the hydrocarbon of the fuel injected from the soot generation burner toward the stainless steel strip surface burns at a low air ratio as mentioned above, since the majority of the inside of such flame is composed of incomplete combustion flame of relatively low temperature while the outside thereof is a high temperature complete combustion flame, it is necessary to lower the combustion temperature by injecting secondary air of relatively low surface temperature from a secondary air nozzle toward the stainless steel strip surface in order to lower the temperature of the outside complete combustion flame. That is, the rate of combustion reaction of the hydrocarbon gas in the fuel, or the rate of soot generation, varies with the low temperature secondary air volume injected from the secondary air nozzle, and the temperature of the furnace atmosphere changes accordingly. However, if the volume of low temperature secondary air injected from the secondary air nozzle is increased, the combustion reaction is promoted, and the flame temperature of the incomplete combustion flame goes up. As the flame temperature elevates, the temperature of the furnace atmosphere rises. Hence, the combustion reaction speed increases, soot generation decreases, and the deposit of soot becomes unsatisfactory. Thus, it is difficult to control the rate of combustion reaction of the hydrocarbon gas of fuel, that is, the rate of soot generation, only by controlling the volume of secondary air injected from the secondary air nozzle or its temperature.

SUMMARY OF THE INVENTION

It is hence a primary object of the invention to provide a method of blackening treating a stainless steel strip surface by generating soot efficiently in a blackening treating furnace installed separately from a continuous annealing furnace at an upstream side thereof. It is possible to anneal at high production efficiency by maintaining a desired target without sacrificing surface properties, by performing continuous annealing of the stainless steel strip in, for example, an open-air horizontal or vertical continuous annealing furnace, depositing the soot uniformly, stably and efficiently on the surface of the stainless steel strip. The rate of combustion reaction of hydrocarbon gas of the fuel, that is the rate of soot generation, and deposition of such soot easily are controlled by solving the problems of the prior art.

The present inventor intensively studied the above problems and completed the invention by discovering the following. The incomplete combustion flame formed by the incomplete burning of the fuel by the soot generation burner and the secondary air separately supplied and injected so as to enclose such incomplete combustion flame are blown toward the surface of the stainless steel strip passed continuously into the blackening treating furnace. The relationship of such two components is controlled to be within a range so as not to cause the flame temperature of the incomplete combustion flame to be raised by the secondary air. A flame guide air is supplied separately and is injected toward the stainless steel strip surface in a direction perpendicular to the direction of movement of the stainless steel strip or at an inclined angle thereto until the combustion reaction flame of the incomplete combustion flame and secondary air blown toward the stainless steel strip surface is sucked and discharged into an exhaust duct, and the combustion reaction flame is fluidized along the stainless steel strip surface in the same direction as the direction of movement thereof, as much as possible. The flame guide air is injected so as not to raise the temperature of the furnace atmosphere in this fluidized flame. Heat withdrawal from the furnace is increased so as to keep low the temperature of the furnace atmosphere. The soot can be deposited on the stainless steel strip surface uniformly, stably and efficiently by more easily controlling the combustion reaction rate or the soot generation reaction rate only by the supply of air into the furnace, the injection method, and the proper air volume.

Thus, as for the soot generated in the process of burning the incomplete combustion flame along the surface of the stainless steel strip, the volume of secondary air blown onto the surface of the stainless steel strip is decreased within a necessary limit together with the incomplete combustion flame in order to prevent progress of the soot generation step up to the oxidation step preferably by cooling the secondary air. The progressed combustion reaction flame of the incomplete combustion flame is fluidized in the direction of movement of the stainless steel strip while pressing along the surface thereof without diffusing into the blackening treating furnace by the flame guide air, thereby cooling the furnace atmosphere so that the temperature does not rise too much. In order to further lower the temperature of the internal atmosphere of the furnace, the entire wall of the blackening treating furnace is enclosed with a water-cooled box, such that a greater cooling effect can be obtained. By also lowering the temperature of the internal atmosphere of the furnace, the soot generation reaction rate may be made moderate, while the soot generation step easily may be controlled to stay within the grouping step and not advance to the oxidation step, depending on the temperature of the flame guide air and injection volume. Therefore, it is possible to control operation so that the combustion step in the blackening treating furnace always will take place at a constant position not advancing to the oxidation step, depending on the speed of movement of the stainless steel strip, by increasing the flow of flame guide air when the speed of movement of the stainless steel strip is fast, or by decreasing the flow of flame guide air when such speed of movement is slow.

Hence, in the blackening treating furnace, since the soot generation step is controlled within the grouping state, not progressing further, it is possible to generate soot to be smoothly formed on the stainless steel strip. The combustion reaction flame containing such soot can be pressed against the surface of the stainless steel strip, so that the soot in a highly density state may be maintained in contact with the strip for a long period of time. Therefore, waste of fuel is decreased, and the soot may be uniformly and stably deposited so as not to be easily peeled off or vaporized.

As described herein, the method of blackening treating of the stainless steel strip surface of the invention is a simple one that can be executed at a relatively low cost. Industrial values of the invention are great, including, among others, the following effects.

(1) If the speed of movement of the stainless steel strip varies, it is possible to control the soot generation step of the incomplete combustion flame formed by incomplete combustion of the fuel by the soot generation burner, and the distribution thereof within the furnace depending on such speed. Soot having the property of easily being deposited can be stably generated, and such soot at high density can be kept in contact with the stainless steep strip surface for a long period of time. As a result, the soot can be efficiently, uniformly and stably deposited on the surface of the stainless steel strip.

(2) Consequently, peeling or vaporization of the soot does not occur easily in the continuous annealing furnace, and the blackened state of the strip can be maintained longer than before. Therefore, the rate of heat absorption rate by stainless steel strip will be stably enhanced, the purpose of the annealing operation will be achieved without abnormality, and the annealing process may be realized at high speed and at a stabilized high quality level.

(3) Fuel consumption required for the blackening treatment is reduced, and the basic unit is lowered. Thus, energy will be saved for the overall annealing process including the continuous annealing furnace.

BRIEF DESCRIPTION OF THE DRAWINGS

Other and further objects, features, and advantages of the invention will be made more explicit from the following detailed description, taken with reference to the drawings, wherein.

DETAILED DESCRIPTION OF THE PREFERRED EMBODIMENT

Figure 1:
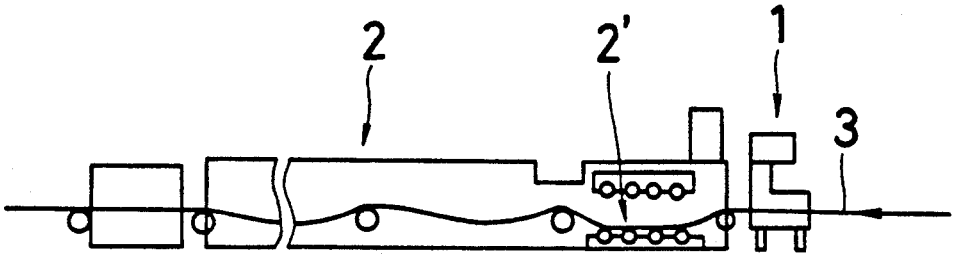
FIG. 1 is a schematic view showing a furnace for blackening treating of the surface of stainless steel strip according to the invention and installed separately from a continuous annealing furnace upstream thereof.

Referring to the drawings, a preferred embodiment of the invention is described below.

Figure 2:
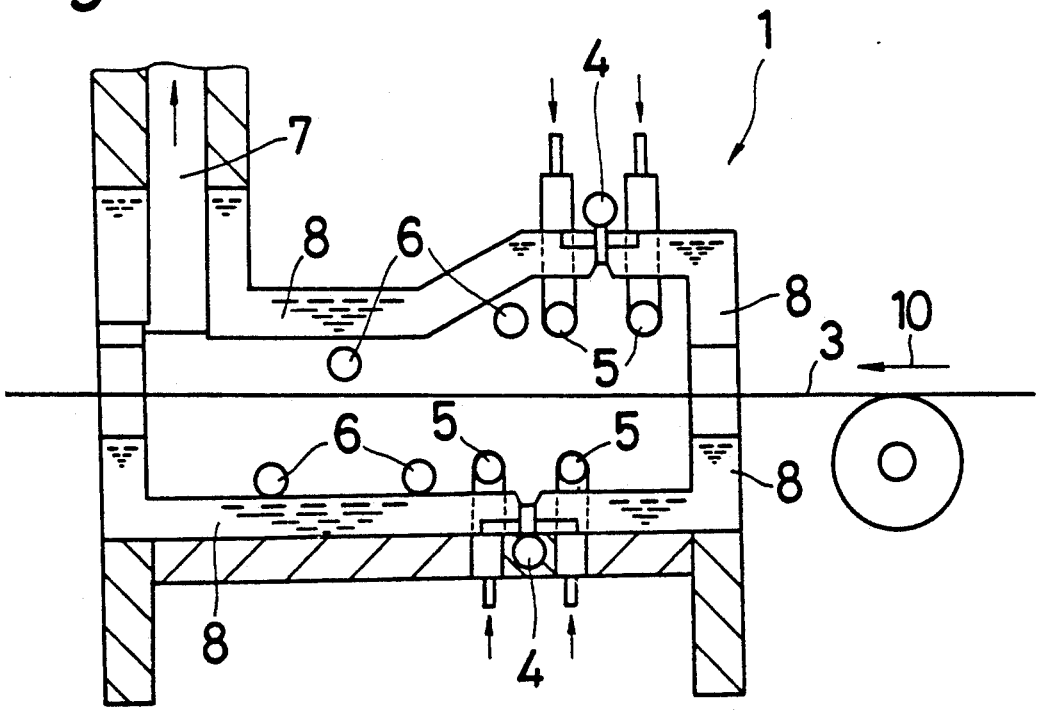
FIG. 2 is a sectional view showing the structure of the blackening treating furnace.
Figure 3:
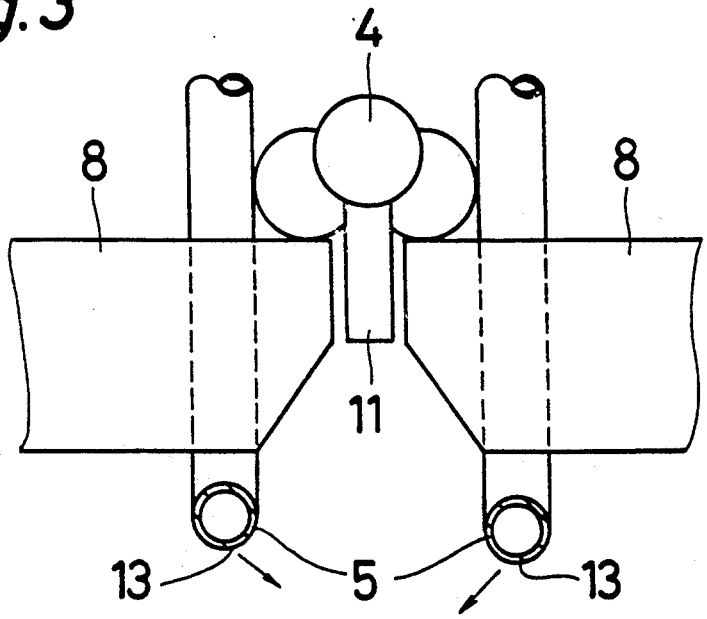
FIG. 3 is an enlarged view of essential parts of a soot generation burner shown in FIG. 2.
Figure 4:
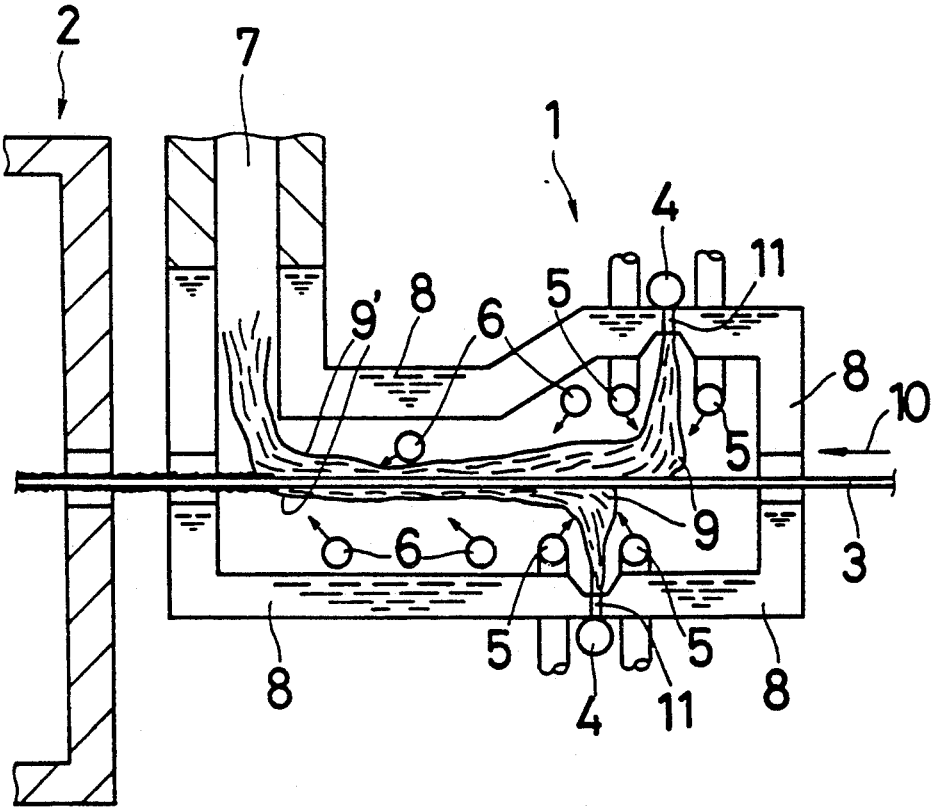
FIG. 4 is a view similar to FIG. 2 but showing a soot deposit process in the blackening treating furnace.
Figure 5:
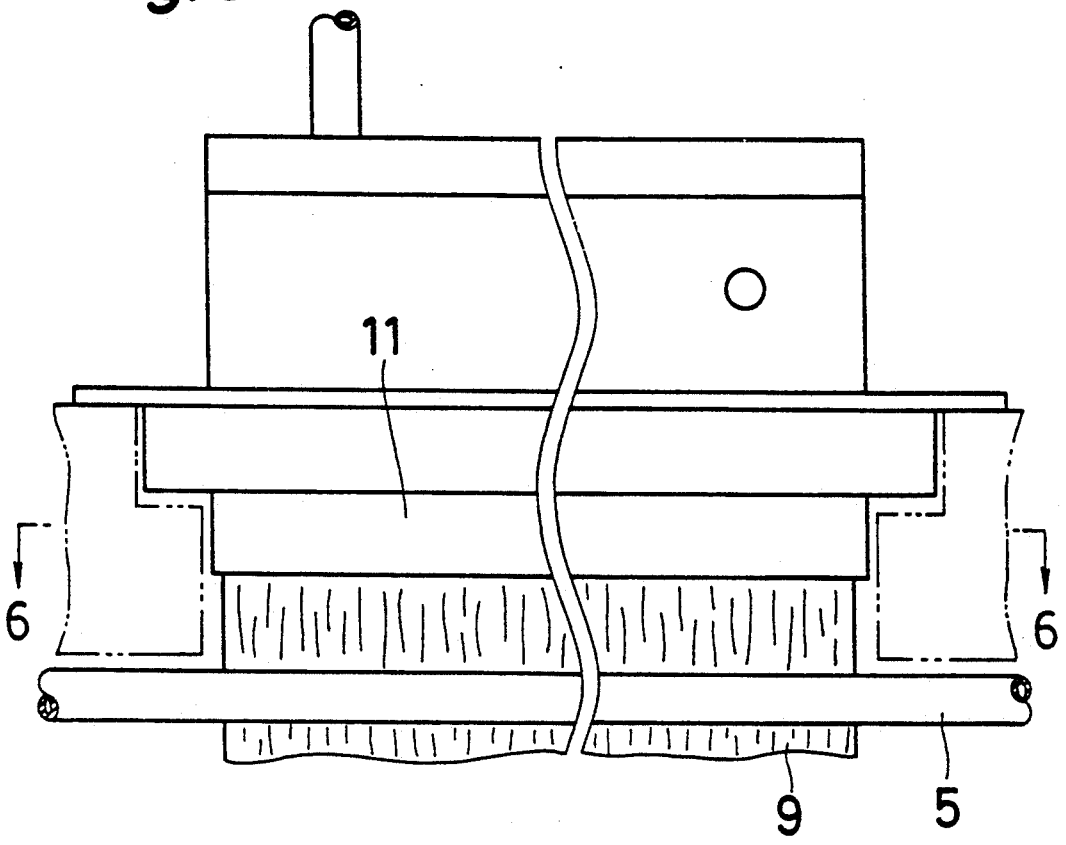
FIG. 5 is a front view showing the relationship between the soot generation burner and a secondary air nozzle in the blackening treating furnace.
Figure 6:
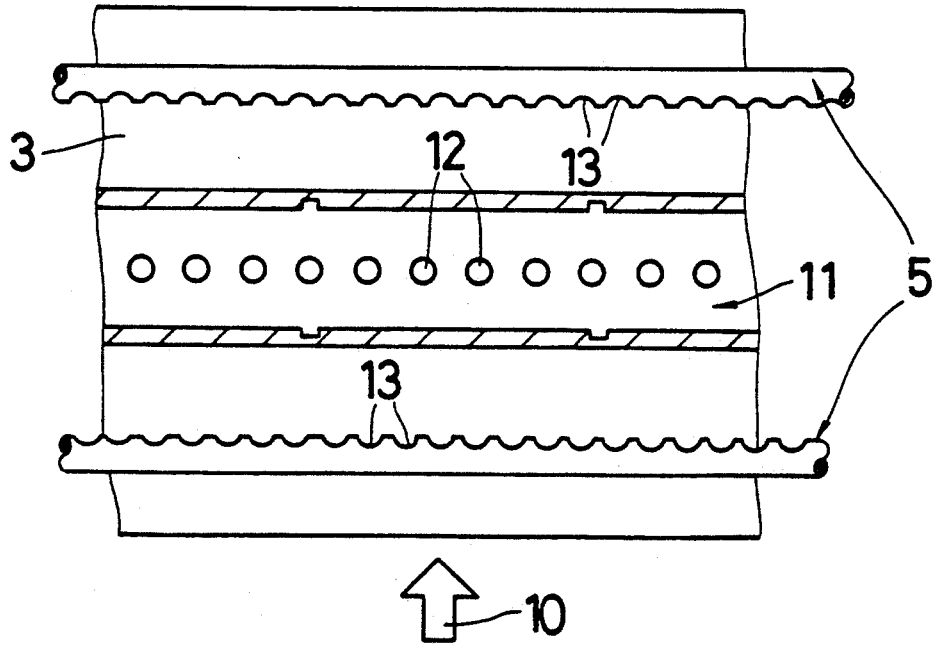
FIG. 6 is a sectional view taken along line 6—6 in FIG. 5.

FIG. 1 is a schematic diagram showing a blackening treating furnace 1 for treating the surface of stainless steel strip 3 of the invention. Furnace is separate from and upstream of a continuous annealing furnace 2 of the horizontal type (catenary type). FIG. 2 shows the structure of the blackening treating furnace 1 in more detail, and FIG. 3 shows in more detail essential parts adjacent one soot generation burner 4 of the furnace. FIG. 4 illustrates a soot deposit process achieved in the blackening treating furnace 1. FIGS. 5 and 6 show a relationship between the soot generation burner 4 and a secondary air nozzle in the blackening treating furnace 1.

As shown in the drawings and as pointed out above, continuous annealing furnace 2 of, for example, the open-air horizontal (catenary) type is installed at the downstream side of the blackening treating furnace 1. Surfaces of stainless steel strip 3 are coated with deposited soot within the blackening treating furnace 1, and strip 3 then is immediately inserted and passed into the continuous annealing furnace 2 and therein heated and annealed. A forced convection preheating zone 2, also may be installed at the upstream side of the continuous annealing furnace 2 in order to blow high temperature gas.

Within the blackening treating furnace 1 are arranged respective soot generation burners 4 for blowing incomplete combustion flames formed by incomplete combustion of the fuel toward the upper and lower surfaces of the stainless steel strip 3. Thereby, the soot generated by burners 4 is deposited on both the upper and lower sides of the stainless steel strip 3, thus achieving the blackening treatment.

Each soot generation burner 4 is a flat burner extended in the widthwise direction of the stainless steel strip 3. Burner 4 includes a burner nozzle 11 having burner nozzle holes 12 spaced substantially at equal intervals along the widthwise direction of the stainless steel strip 3 (FIGS. 5 and 6). At the side of the burner nozzle 11 directed toward strip 3 are a pair of secondary air nozzles 5 that are elongated in directions parallel to the burner nozzle 11. Nozzles 5 are installed at opposite sides of nozzle 11 at positions enclosing an incomplete combustion flame 9 issuing from the burner nozzle holes 12 of the burner nozzle 11. Secondary air nozzle holes 13 of the secondary air nozzles 5 extend in directions slightly inclined toward the incomplete combustion flame 9 or in directions perpendicular to the respective surface of the stainless steel strip 3. The secondary air nozzle holes 13 inject secondary combustion air cooled to 20° C. or less, preferably which is supplied from outside the blackening treating furnace 1, separate from the oxygen, air, or oxygen-enriched air supplied to the soot generation burner 4.

The incomplete combustion flame 9 blown from the burner nozzle holes 12 of the burner nozzle 11 of the soot generation burner 4 contains substantial unburnt gas including soot resulting from incomplete combustion of hydrocarbon gas of the fuel. Oxygen, air or oxygen-enriched air supplied to burner 4 is in a quantity equal to 0.3 or less than the amount of oxygen required for complete combustion of the fuel. Therefore, when the secondary air is blown onto the surface of the stainless steel strip 3, the combustion reaction of the fuel is further progressed somewhat by such low temperature secondary air, i.e. there occurs a secondary combustion reaction flame 9'. The incomplete combustion flame 9 is enclosed or enveloped by the secondary air issuing from nozzle holes 13 of the pair of secondary air nozzles 5. The secondary combustion reaction flame 9' from the incomplete combustion flame 9 blown toward the surface of the stainless steel strip 3 and the secondary air are drawn to and discharged into an exhaust duct 7 installed at the downstream end of the blackening treating furnace 1, as schematically shown in FIG. 4. The gas drawn to and discharged from the exhaust duct 7 may be effectively used again in the blackening treating furnace 1 and used in the continuous annealing furnace 2 downstream thereof.

An arbitrary number of flame guide air nozzles 6 are disposed between the pair of secondary air nozzles 5 and the exhaust duct 7. The flame guide air nozzles 6 are inject flame guide air cooled at a low temperature, preferably below 20° C., toward the respective surface of the stainless steel strip 3. Such flame guide air is injected in directions perpendicular to the direction of movement 10 of the stainless steel strip 3 or in directions inclined downstream to direction 10. The secondary combustion reaction flame 9' from the incomplete combustion flame 9 and secondary air still contains unburnt gas including soot that still is not burnt completely by the secondary combustion. Therefore, the combustion reaction is further promoted by the flame guide air injected from the flame guide air nozzles 6. Such continued combustion avoids soot from the incomplete combustion flame 9 being directly discharged from the exhaust duct 7.

Thus, the incomplete combustion flame 9 formed by incomplete combustion of the fuel by the soot generation burner 4 progressively undergoes continued combustion reaction while varying the internal atmospheric temperature within the furnace, depending on the air flow and air temperature of the secondary air and flame guide air. Therefore, such continued combustion reaction can be retarded by lowering the air temperature and decreasing the flow, and can be accelerated by raising the air temperature and increasing the flow.

Generally however, when the air flow is increased, the flame temperature rises, and the combustion reaction is accelerated depending on the extent of such temperature elevation. It is difficult to control the combustion reaction rate only by the secondary air flow and its temperature. It is possible to suppress elevation of the flame temperature by lowering the atmospheric temperature within the furnace and thereby arrest an increase of combustion reaction rate that would be caused by elevation of the flame temperature. This can be done by controlling within a proper range the overall combustion reaction rate of the incomplete combustion flame 9 without attempting to reduce the temperature by increasing the secondary air flow injected from the secondary air nozzle holes 13 of the pair of secondary air nozzles 5. Rather, this can be done by a controlled further combustion from low temperature flame guide air injected from the flame guide air nozzles 6 to the combustion reaction flame 9' of the secondary air and incomplete combustion flame 9 flowing in the direction of movement 10 of the stainless steel strip 3. The secondary air and the flame guide air are cooled to as low a temperature as possible, preferably 20° C. or less. Further preferably, the furnace body may be enclosed in a water-cooled box 8. By the use of such means, the internal atmospheric temperature within the furnace can be controllably lowered. As a result, the soot generation process can be controlled only by the adjustment of the air flow rate.

The invention may be embodied in other specific forms without departing from the spirit or essential characteristics thereof. The present embodiment therefore is to be considered in all respects as illustrative and not restrictive, the scope of the invention being indicated by the appended claims rather than by the foregoing description, and all changes which come within the meaning and the range of equivalency of the claims are therefore intended to be embraced therein.

What is claimed is:

1. A method of blackening treatment of a surface of a stainless steel strip moved through a treating furnace positioned upstream of a continuous annealing furnace, said method comprising:

incompletely combusting a fuel in a soot generation burner to thereby generate an incomplete combustion flame including soot and directing said incomplete combustion flame toward said surface within said treating furnace, such that said soot deposits on and blackens said surface;

injecting secondary combustion air into said treating furnace toward said surface, separately from said soot generation burner at positions to enclose said incomplete combustion flame, and thereby combusting further said fuel from said incomplete combustion flame to form a combustion reaction flame;

injecting flame guide air, separately from said soot generation burner and said secondary combustion air, into said treating furnace toward said surface in a direction perpendicular to a direction of movement of said strip through said treating furnace or in a direction inclined downstream to said direction of movement; and causing said combustion reaction flame to flow along said surface parallel to said direction of movement.

2. A method as claimed in claim 1, comprising injecting said secondary combustion air into said treating furnace at a temperature of no more than 20° C. and thereby retarding an increase of internal temperature within said treating furnace resulting from said combusting.

3. A method as claimed in claim 1, comprising injecting said flame guide air into said treating furnace at a temperature of no more than 20° C. and thereby retarding an increase of internal temperature within said treating furnace resulting from said combusting.

4. A method as claimed in claim 1, comprising injecting said secondary combustion air and said flame guide air into said treating furnace at a temperature of no more than 20° C. and thereby retarding an increase of internal temperature within said treating furnace resulting from said combusting.

5. A method as claimed in claim 1, further comprising water cooling said treating furnace and thereby retarding an increase of internal temperature therein resulting from said combusting.

6. A method as claimed in claim 1, wherein said incompletely combusting comprises supplying said soot generation burner with hydrocarbon gas as said fuel and a quantity of oxygen equal to no more than 0.3 times the quantity of oxygen required for complete combustion of said hydrocarbon gas.

7. A method as claimed in claim 1, comprising injecting said secondary combustion air in directions perpendicular to said direction of movement or inclined toward said incomplete combustion flame.

8. A method as claimed in claim 1, comprising drawing said combustion reaction flame to an exhaust duct at a downstream end of said treating furnace and discharging gas from said treating furnace through said exhaust duct.

* * * * *